US008323126B1

(12) United States Patent
Lozier

(10) Patent No.: US 8,323,126 B1
(45) Date of Patent: Dec. 4, 2012

(54) TRAINING DEVICE—LACROSSE BALL HANDLING

(76) Inventor: Mitchell Evan Lozier, Elkhart, IN (US)

( * ) Notice: Subject to any disclaimer, the term of this patent is extended or adjusted under 35 U.S.C. 154(b) by 148 days.

(21) Appl. No.: 12/782,422

(22) Filed: May 18, 2010

Related U.S. Application Data

(60) Provisional application No. 61/179,485, filed on May 19, 2009.

(51) Int. Cl.
*A63B 69/00* (2006.01)

(52) U.S. Cl. ..... 473/446; 473/513

(58) Field of Classification Search ..... 473/505, 473/512, 513, 488, 479, 422, 446; D21/724; 294/181; 223/13
See application file for complete search history.

(56) References Cited

U.S. PATENT DOCUMENTS

| | | | | | |
|---|---|---|---|---|---|
| 132,634 | A * | 10/1872 | Colthar | 56/339 |
| 462,386 | A * | 11/1891 | Reno et al. | 56/339 |
| 925,885 | A * | 6/1909 | Fahnestock | 56/339 |
| 1,166,735 | A * | 1/1916 | Annis | 56/339 |
| 2,029,790 | A * | 2/1936 | Philipp | 473/513 |
| 2,075,372 | A * | 3/1937 | Taylor | 473/513 |
| 2,710,753 | A * | 6/1955 | Lockwood | 473/513 |
| 3,910,578 | A * | 10/1975 | Brine, Jr. | 473/513 |
| 5,174,580 | A * | 12/1992 | Pratt | 473/513 |
| 7,244,200 | B2 * | 7/2007 | Goldberg | 473/513 |
| 7,445,571 | B2 * | 11/2008 | Winningham | 473/513 |
| 2009/0075765 | A1 * | 3/2009 | Eldridge | 473/513 |

OTHER PUBLICATIONS

Webpage download, STX Lacrosse Training Set , 2004, www.amazon.com/STX-Lacrosse-Training-Set-Blue/dp/B0000BYT27, 3 pages.*

* cited by examiner

*Primary Examiner* — Gene Kim
*Assistant Examiner* — M Chambers
(74) *Attorney, Agent, or Firm* — Gardner, Linn, Burkhart & Flory, LLP

(57) ABSTRACT

A training device comprising a pole and a frame mounted to the pole. The frame supports a pocket for holding a ball therein. A support is mounted to the device adjacent the pocket to thereby form a barrier for holding a ball in the pocket when the ball is positioned in the pocket.

8 Claims, 3 Drawing Sheets

① BLOCKER TAB
② ATTACHMENT SCREW
③ BLOCKER BASE
④ SHAFT-LAX STICK
⑤ POCKET MATERIAL-LAX STICK
⑥ HEAD FRAME-LAX STICK
⑦ LAX STICK

1. BLOCKER TAB
2. ATTACHMENT SCREW
3. BLOCKER BASE
4. SHAFT-LAX STICK
5. POCKET MATERIAL-LAX STICK
6. HEAD FRAME-LAX STICK
7. LAX STICK

1. BLOCKER TAB
2. ATTACHMENT SCREW
4. SHAFT - LAX STICK
5. POCKET MATERIAL - LAX STICK
6. HEAD FRAME - LAX STICK
7. LAX STICK

8 ATTACHMENT HOLE

9 BLOCKER STRAND

4 SHAFT - LAX STICK

5 POCKET MATERIAL - LAX STICK

6 HEAD FRAME - LAX STICK

7 LAX - STICK

TRAINING DEVICE—LACROSSE BALL HANDLING

CROSS-REFERENCE TO RELATED APPLICATION

This application claims priority from U.S. Pat. Provisional application Ser. 61/179,485, filed May 19, 2009, entitled TRAINING DEVICE-LACROSSE BALL HANDLING, which is incorporated by reference herein in its entirety.

TECHNICAL FIELD AND BACKGROUND OF THE INVENTION

The present invention relates to a lacrosse training device, more specifically to a ball handling training device.

Lacrosse is known as the fastest game on two feet—a game of speed, skill and contact. The fundamental acts of throwing, catching, and shooting a lacrosse ball can be learned to a minimum proficiency level by a novice player rather quickly. However, for the beginning lacrosse player, the combination of skills required for ball handling in an active game or practice drill setting can make it difficult to master without becoming discouraged and frustrated due to the difficulty of keeping the ball in the pocket and not letting it fall to the ground.

Lacrosse is different than the traditional "stick and ball" games of baseball, hockey, or tennis in that the ball is cradled or held in the pocket formed by the webbing and head frame at the end of the stick which is extended away from the body. Cradling requires repetitive movement of the stick in a semi-circular path such that a centrifugal force is generated to keep the ball pushed against the back of the pocket so that it does not fall out. This extended balancing action is further complicated when actively playing the game and being required to run, change direction, and absorb contact from other players. Often, the novice player will place their thumb above the bottom of the pocket and hold the ball in the pocket. This bad habit is illegal in lacrosse and is an action that will need to be "unlearned" as the ability of the player increases. Without the aid of a training device such as is presented here, the novice player will drop the ball many times creating a frustration which could jeopardize their confidence and long term interest in the game.

There are presently devices designed as ball handling training aids which limit the range a ball will travel if it comes out of the pocket and therefore increases the opportunity for a novice player to improve their ball handling skills. However, because this device is essentially a ball attached to the stick by a relatively short string—it can not be used in an active game setting depriving the novice player of a means to improving their ball handling while they are running, changing direction, and absorbing contact and while also being able to throw catch and shoot.

Therefore, a device that can assist the novice player with keeping the ball in the pocket as they are learning proper cradling movement and balance while actively playing the game (running, changing directions and absorbing contact and while throwing, catching, and shooting) will be beneficial. Thoughtful design of such a device will provide an adjustable level of assistance that can gradually be removed until such a point that the novice player is actively cradling the ball without any assistance provided. Further consideration will yield a device that can be used without creating any limitation on the adjustments and customization of the pocket geometry of a lacrosse stick or any alteration which would cause the lacrosse stick to be deemed not to be of legal design or configuration after the device is removed.

SUMMARY OF THE INVENTION

Accordingly, the present invention provides a support which is attached to the frame or shaft of a lacrosse stick which provides assistance to keep the ball in the pocket.

In one form of the invention, a base member attached to the shaft of a lacrosse stick provides a means to support a blocker tab in front of the pocket.

In one aspect, the blocker tab is interchangeable with similar tabs that vary in height and width providing more or less assistance to keep the ball in the pocket.

In another aspect, the blocker tab provides a means of movement such that it can be adjusted to produce more or less assistance to keep the ball in the pocket.

In another aspect, the blocker tab is made of a semi-rigid material that provides an added level of variability with respect to the amount of assistance provided to keep the ball in the pocket.

In another form of the invention, the base member described above is incorporated into the design of the frame of the lacrosse stick head.

In one aspect, the blocker tab is interchangeable with similar tabs that vary in height and width providing more or less assistance to keep the ball in the pocket.

In another aspect, the blocker tab provides a means of movement such that it can be adjusted to produce more or less assistance to keep the ball in the pocket.

In another aspect, the blocker tab is made of a semi-rigid material that provides an added level of variability with respect to the amount of assistance provided to keep the ball in the pocket.

In another form of the invention, a blocker strand is secured transversely across the lower opening of the lacrosse stick head.

In one aspect, multiple attachment points are provided such that the blocker strand can be adjusted to produce more or less assistance to keep the ball in the pocket.

In another aspect, the blocker strand may be varied in geometry to such that it can produce more or less assistance to keep the ball in the pocket.

In another aspect, the blocker strand may be made of a semi-rigid or elastic material that provides an added level of variability with respect to the amount of assistance provided to keep the ball in the pocket.

These and other objects, advantages, purposes, and features of the invention will become more apparent from the study of the following description taken in conjunction with the drawings.

DETAILED DESCRIPTION OF THE PREFERRED EMBODIMENTS

Figure 1:
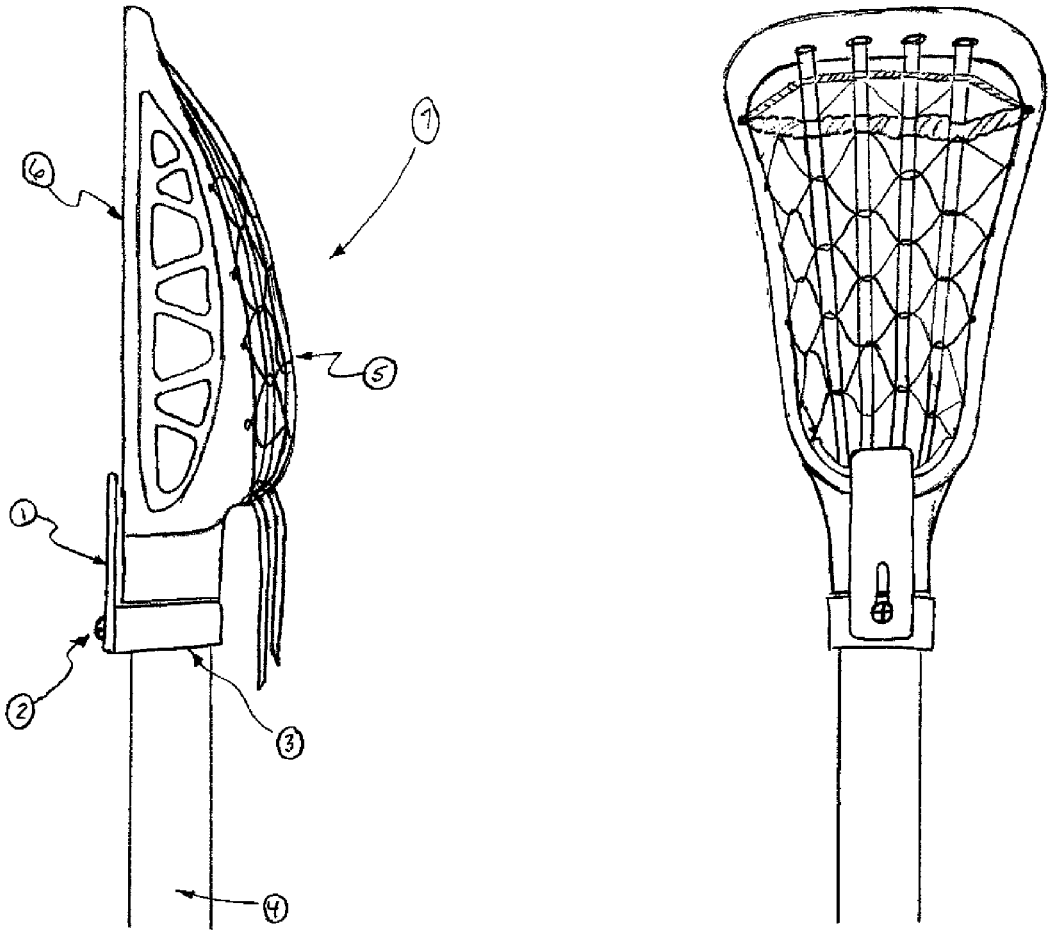
FIG. 1 shows a side and front view of a lacrosse stick with a support in the form of a blocker tab attached to a base component.

Referring to FIG. 1, the numeral 7 generally designates a lacrosse stick comprised of components which may include a shaft or pole 4, pocket 5, which may formed from a net or mesh material, and a head frame 6. Also in FIG. 1, the numeral 1 designates a support in the form of a blocker tab which is attached to the blocker base 3 by means of an attachment screw 2 to form a barrier or wall adjacent pocket 5.

Additionally in FIG. 1, it is noted that blocker tab 1 has a slot oriented along the axis of the shaft 4. This allows the blocker tab 1 to be raised and lowered relative to the head frame 6 creating more or less assistance to keep a ball in the pocket of the lacrosse stick. Blocker tab 1 can also be made with finite staged holes, as interchangeable pieces with finite staged holes, or other such features in place of the slot that allow attachment via attachment screw 2 and consequently adjustability of blocker tab 1. Also, the attachment screw 2 may be a snap connection or the like as a means of making blocker tab 1 repositionable. Therefore, it should be noted that the means of positioning and attachment of blocker tab 1 can be varied to suit the needs of the manufacturer or user.

Further, blocker tab 1 can be made of materials with varying physical properties to also achieve more or less assistance to keep a ball in the pocket of the lacrosse stick. For example, tab 1 may be made from a rigid plastic or a flexible material, such as rubber or a material with rubber characteristics. Further, the tab may have a thickness that varies along its length (e.g. tapers downwardly from its proximal end that mounts to the blocker base 3 to its distal end) to thereby provide a tab with a stiffness that varies along it length.

Also in FIG. 1, it is noted that blocker base 3 can be made such that it is removable from the shaft. Blocker tab 1, by its nature can also be removed from the lacrosse stick individually. Removal of the blocker tab 1 by either means yields a lacrosse stick of legal design and configuration.

In addition, the blocker tab may be forked with multiple tines, whose thickness and length can be varied to vary the stiffness or resilience of the tab at the distal end of the tab. Further, the tab may be formed as a composite of several tabs, which allow the tab thickness and/or width to be varied by removing one or more of the tabs or by offsetting one or more tabs. For example, the tab may be formed from a plurality of stacked tabs, which then can be adjusted so that they overlap but are not longer aligned and then ultimately removed to reduce the composite tab's thickness and hence stiffness. It should be understood that by reducing the tab's stiffness or increasing the tabs resilience the assistance is reduced.

Figure 2:
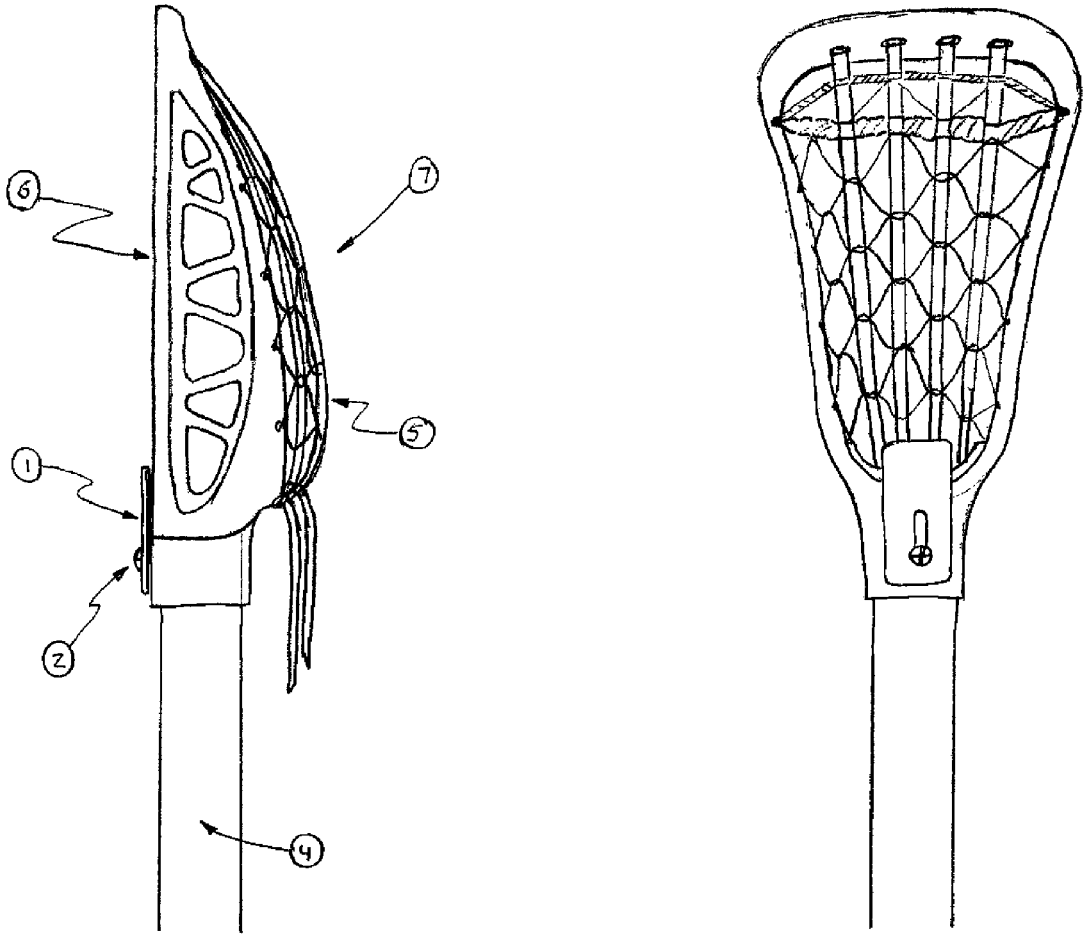
FIG. 2 shows a side and front view of a lacrosse stick with a support in the form of a blocker tab incorporated into the frame of the head.

Referring to FIG. 2, the numeral 7 generally designates a lacrosse stick comprised of components which may include a shaft 4, pocket 5, and a head frame 6. Also in FIG. 2, the numeral 1 designates a support in the form of a blocker tab which is attached to the head frame 6 by means of an attachment screw 2.

Additionally in FIG. 2, it is noted that blocker tab 1 has a slot oriented along the axis of the shaft 4. This allows the blocker tab 1 to be raised and lowered relative to the head frame 6 creating more or less assistance to keep a ball in the pocket of the lacrosse stick. It should be understood that the means of varying the position and attachment of blocker tab 1 outlined in the FIG. 1 description above apply to FIG. 2 as well.

Further, blocker tab 1 can be made of materials with varying physical properties to also achieve more or less assistance to keep a ball in the pocket of the lacrosse stick, as noted above.

Also in FIG. 2, it is noted that blocker tab 1, by its nature can be removed from the lacrosse stick individually yielding a lacrosse stick of legal design and configuration.

Figure 3:
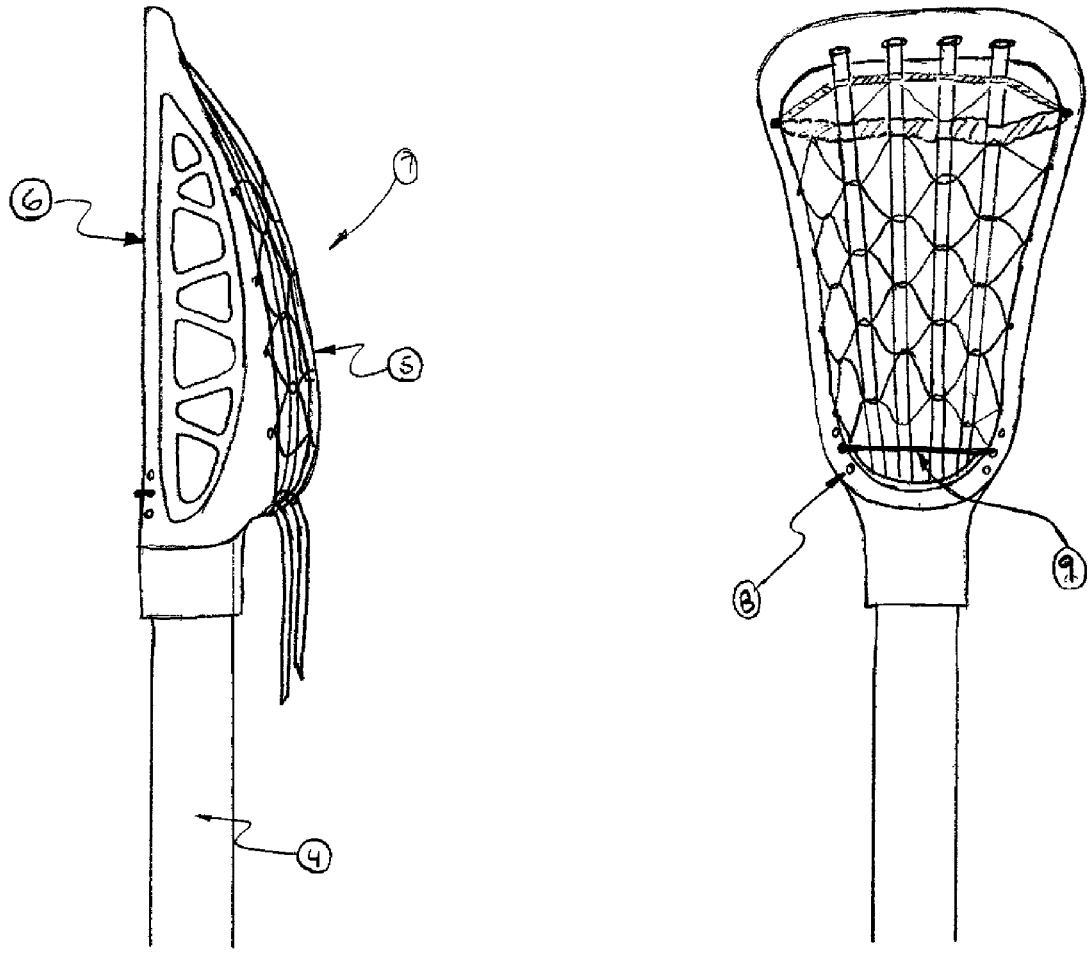
FIG. 3 shows a side and front view of a lacrosse stick with a support incorporated into the frame of the head in the form of an elongated member.

Referring to FIG. 3, the numeral 7 generally designates a lacrosse stick comprised of components which may include a shaft 4, pocket 5, and a head frame 6. Also in FIG. 3, the numeral 9 designates a support in the form of an elongate member, such as a rod, including a plastic rod, or a flexible elongate member, such as a cord, including an elastic cord, or a strand, which is attached to the head frame 6 at attachment holes 8. Although one elongate member is illustrated, it should be understood that multiple elongate members may be used. For example an elongate member may be mounted in each of the attachment holes to form a plurality of generally parallel spaced apart barriers—similar to a fence.

Additionally in FIG. 3, the plurality of attachment holes 8 are shown to demonstrate the variability of the position of elongate member 9. This allows the elongate member 9 to be raised and lowered relative to the head frame 6 creating more or less assistance to keep a ball in the pocket of the lacrosse stick. Further, the attachment hole 8 can be a hook, snap-lock recess, or other such features to provide adjustability of elongate member 9.

Further, as noted, elongate member 9 can be made of materials with varying physical properties to also achieve more or less assistance to keep a ball in the pocket of the lacrosse stick.

Also in FIG. 3, it is noted that elongate member 9, by its nature can be removed from the lacrosse stick individually yielding a lacrosse stick of legal design and configuration.

While several forms of an adjustable blocker device to assist in keeping the ball in the pocket of a lacrosse stick have been described, it should be understood that the invention is not limited to the specific form of the blocker devices illustrated and described herein and, further may be formed from multiples of blocker tabs or strands or combinations of both. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

I claim:

1. A training device for lacrosse ball handling, said training device comprising:

a lacrosse pole;

a lacrosse head frame mounted to said pole;

a lacrosse net supported by said lacrosse head frame, said lacrosse net forming a pocket for holding a lacrosse ball therein including when the lacrosse ball is positioned above at least a portion of said lacrosse head frame; and a support mounted to said device adjacent said pocket to thereby form a barrier for engaging and holding a lacrosse ball in said pocket when the lacrosse ball is positioned in said pocket and above at least a portion of said lacrosse head frame;

wherein said lacrosse pole, said lacrosse head frame, said lacrosse net, and said support are assembled and configured to permit catching, retaining, and throwing of the lacrosse ball wherein said support includes a base member and a tab, said base member attached to said lacrosse pole, said base supporting said tab in front of said pocket, wherein said tab is movably mounted to said base member wherein the height of said barrier formed by said tab can be varied to thereby vary the assistance provided by said tab to keep the lacrosse ball in said pocket.

2. The training device according to claim 1, wherein said tab is releasably mounted to said base member wherein said tab is interchangeable with another tab with a varied height or width to thereby vary the assistance provide by the tab to keep the lacrosse ball in said pocket.

3. The training device according to claim 1, wherein said support comprises an elongated member.

4. A lacrosse ball handling training device comprising:

a lacrosse pole;

a lacrosse head frame mounted to said lacrosse pole;

a lacrosse net supported by said lacrosse head frame, said lacrosse net forming a pocket for retaining a lacrosse ball positioned therein including when (i) said lacrosse pole and said lacrosse head frame are oriented substantially vertically, and (ii) the lacrosse ball is positioned above at least a portion of said lacrosse head frame, wherein said lacrosse pole, said lacrosse head frame, and said lacrosse net are assembled and configured to permit catching, retaining, and throwing of the lacrosse ball; and a support mounted to said device and spaced outwardly from said pocket to thereby form a barrier for engaging and holding the lacrosse ball in said pocket when the lacrosse ball is positioned in said pocket and above at least a portion of said lacrosse head frame with said lacrosse pole and said lacrosse head frame oriented substantially vertically and wherein said support includes a base member and a tab, said base member attached to said lacrosse pole or said lacrosse head frame, said base supporting said tab in front of said pocket wherein said tab is movably mounted to said base member so that the height of said barrier formed by said tab can be varied to thereby vary the assistance provided by said tab to retain the lacrosse ball in said pocket.

5. The training device according to claim 4, wherein said support is coupled to said lacrosse head frame.

6. The training device according to claim 5, wherein said support is movably coupled to said lacrosse head frame wherein the position of said support may be adjusted relative to said lacrosse head frame and said pocket.

7. The training device according to claim 4, wherein said tab is releasably mounted to said base member wherein said tab is interchangeable with another tab with a varied height or width to thereby vary the assistance provide by the tab to retain the lacrosse ball in said pocket.

8. A lacrosse ball handling training device comprising:

an elongate lacrosse pole having opposite end portions and a longitudinal axis;

a lacrosse head frame having a base mounted at one of said opposite end portions of said lacrosse pole, said lacrosse head frame extending beyond said one of said opposite end portions along said longitudinal axis, and said lacrosse head frame defining an opening;

a lacrosse net supported by said lacrosse head frame along a rear side thereof, said lacrosse net substantially covering said opening and forming a pocket for releasably retaining a lacrosse ball positioned therein when said lacrosse pole and said lacrosse head frame are oriented substantially vertically and the lacrosse ball is positioned above at least a portion of said lacrosse head frame, wherein said lacrosse pole, said lacrosse head frame, and said lacrosse net are assembled and configured to permit catching, retaining, and throwing of the lacrosse ball; and a blocker tab having a proximal end portion mounted to said lacrosse head frame along a front side thereof, and having a distal end portion that extends in front of said pocket formed in said lacrosse net and is spaced forwardly from said pocket to thereby form a barrier that covers a portion of said opening for engaging and holding the lacrosse ball in said pocket when the ball is positioned in said pocket and above at least said base of said lacrosse head frame with said lacrosse pole and said lacrosse head frame oriented substantially vertically and wherein said support includes a base member and a tab, said base member attached to said lacrosse pole or said lacrosse head frame, said base supporting said tab in front of said pocket wherein said tab is movably mounted to said base member so that the height of said barrier formed by said tab can be varied to thereby vary the assistance provided by said tab to retain the lacrosse ball in said pocket.

* * * * *

UNITED STATES PATENT AND TRADEMARK OFFICE

CERTIFICATE OF CORRECTION

PATENT NO. : 8,323,126 B1
APPLICATION NO. : 12/782422
DATED : December 4, 2012
INVENTOR(S) : Mitchell Evan Lozier It is certified that error appears in the above-identified patent and that said Letters Patent is hereby corrected as shown below:

Column 4:
Line 57, Claim 1, insert --or said lacrosse head frame-- after "pole";

Column 4:
Line 61, Claim 1, "keep" should be --retain--.

Signed and Sealed this
Second Day of April, 2013

Teresa Stanek Rea
*Acting Director of the United States Patent and Trademark Office*